United States Patent [19]

Webb

[11] 4,030,479

[45] June 21, 1977

[54] SOLID FUEL HEATER WITH BLOWBACK PREVENTION MEANS

[75] Inventor: Nolan J. Webb, Marionville, Mo.

[73] Assignee: McNeil Corporation, Akron, Ohio

[22] Filed: June 23, 1976

[21] Appl. No.: 698,826

[52] U.S. Cl. ..... 126/287; 110/158; 126/290; 236/10; 126/67

[51] Int. Cl.[2] ..... F23L 3/00

[58] Field of Search ..... 126/286, 287, 287.5, 126/290, 15 R, 61, 66, 77, 67, 112; 110/158, 175; 236/10, 16

[56] References Cited

UNITED STATES PATENTS

| | | | |
|---|---|---|---|
| 660,456 | 10/1900 | Pinther | 110/175 R |
| 2,348,933 | 5/1944 | Seeley | 126/287 X |
| 2,394,441 | 2/1946 | Griswold | 126/67 |
| 2,714,993 | 8/1955 | Gardiner | 126/15 R |

*Primary Examiner*—William F. O'Dea
*Assistant Examiner*—Harold Joyce
*Attorney, Agent, or Firm*—Mason, Fenwick & Lawrence

[57] ABSTRACT

A solid fuel burning heater has an inner combustion chamber housing enclosed within an outer housing with a fuel feed door in the inner combustion chamber housing being aligned with an outer housing door; an air inlet in the bottom of the combustion chamber housing has a thermostatically controlled air inflow closure valving member connected to a wire bail having an upper end encircling a cam rod connected to the outer housing door. Opening movement of the outer housing door moves the cam rod so that the air inflow closure valving member is opened to provide combustion air into the combustion chamber and prevent blowback upon the subsequent opening of the fuel feed door.

12 Claims, 4 Drawing Figures

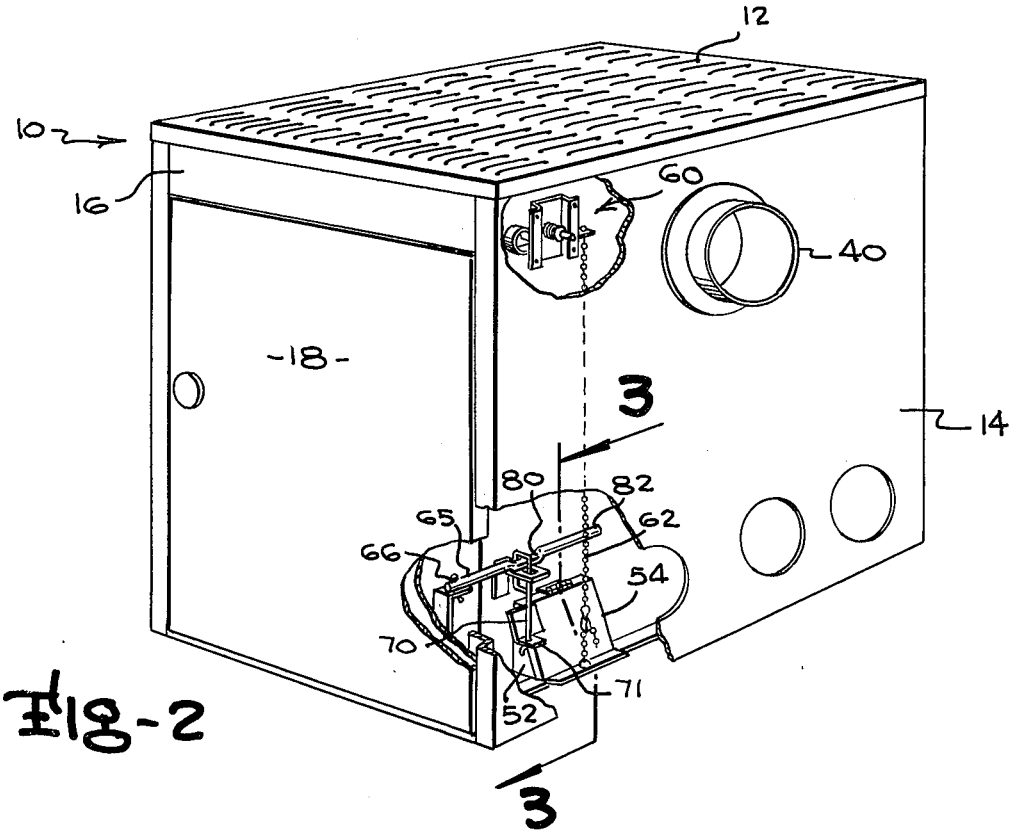
Fig-2
Fig-3
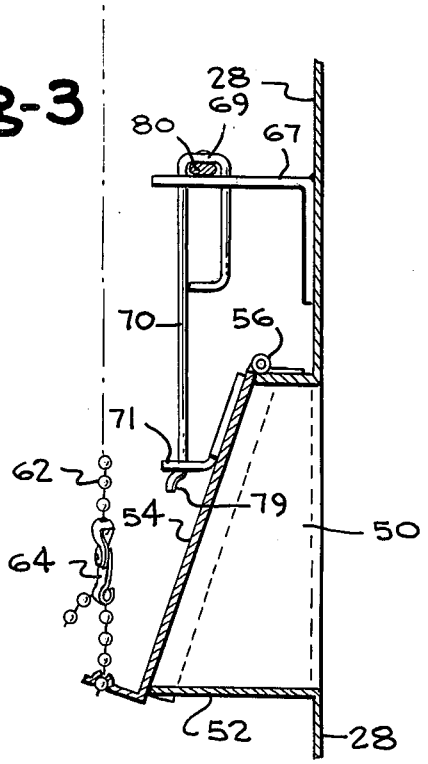
Fig-4
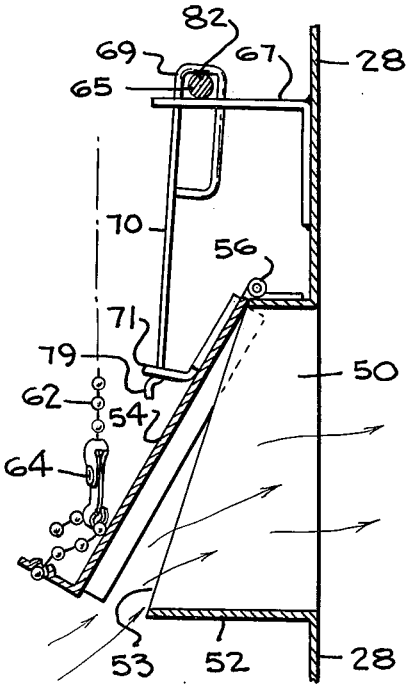

SOLID FUEL HEATER WITH BLOWBACK PREVENTION MEANS

This invention is in the field of solid fuel heaters and the like and is specifically directed to such a heater of the type frequently employed in heating dwellings or other buildings.

Previously known heaters of the type burning solid fuels such as wood or coal have employed a combustion chamber housing which is surrounded and fully enclosed by an outer housing. The combustion chamber housing normally includes a fuel feed door through which fuel is introduced into the combustion chamber with another door being provided in the outer housing to permit access to the fuel feed door. Heaters of the foregoing type frequently employ a combustion air inlet communicating with the lower portion of the combustion chamber and having control means for varying the amount of air permitted to enter the combustion chamber in accordance with the temperature adjacent the combustion chamber housing. A valve flap or the like is provided to regulate the inflow of combustion air with the combustion air being frequently largely cut off when the temperature rises above a certain point; however, the solid fuel and gases emitted therefrom remain in the combustion chamber and are readily ignitable upon receiving a fresh supply of oxygen. Unfortunately, the opening of the fuel feed door to the combustion chamber under the foregoing conditions results in a rapid admission of air into the combustion chamber so that the gases and solid fuel in the chamber are immediately ignited to frequently cause a blowback or flashing of fire and smoke from the open door to the consequent inconvenience of and danger to the person using the heater.

It is the primary object of this invention to prevent blowback of fire and smoke and other products in the combustion chamber of solid fuel heater when the fuel feed door on the heater is open.

Achievement of the object of this invention is enabled in the preferred embodiment in which valving means for the combustion air comprises a pivotable closure member formed of sheet metal or the like which is hinged along an upper edge and is positioned to enable blocking or varying throttle flow of air into the combustion chamber. A thermostat means is positioned above the closure member and is connected thereto by a flexible chain so as to provide a controlled positioning of the closure member to admit quantities of combustion air which will vary in accordance with the temperature in the heater housing. Safety means are provided for opening the closure member automatically in response to the opening of the outer housing door. This safety means comprises an elongated cam member in the form of a rod having an upper surface which includes a depressed portion and a raised or elevated portion. One end of the cam rod is pivotally connected to the outer housing door and the other end rests upon a slide plate bracket-like member positioned above the pivotable closure member. A wire bail has a loop at its upper end which is positioned about a cam rod and which rests in the depressed portion of the upper surface of the cam rod when the outer housing door is closed. The lower end of the wire bail is connected to the pivotable closure member and opening meovement of the outer housing door serves to move a raised portion of the upper surface of the cam rod beneath and into supporting engagement with the loop on the upper end of the wire bail to cause a consequent vertical upward movement of the wire bail member. The upward movement of the wire bail member serves to open the pivotable closure member to admit combustion air so that the subsequent opening of the fuel feed door will not result in a rapid inflow of combustion air and ignition of the products in the combustion chamber to create a dangerous blowback problem.

A better understanding of the manner in which the preferred embodiment of the invention achieves the objects of the invention will be enabled when the following written description is considered in conjuction with the appended drawings in which:

FIG. 2 is a perspective view similar to FIG. 1 but illustrating the outer housing door in a closed condition with portions of the outer housing being removed to illustrate the air inflow control means;

FIG. 3 is a sectional view taken along lines 3—3 of FIG. 2; and

FIG. 4 is a sectional view taken along lines 4—4 of FIG. 1.

Figure 1:
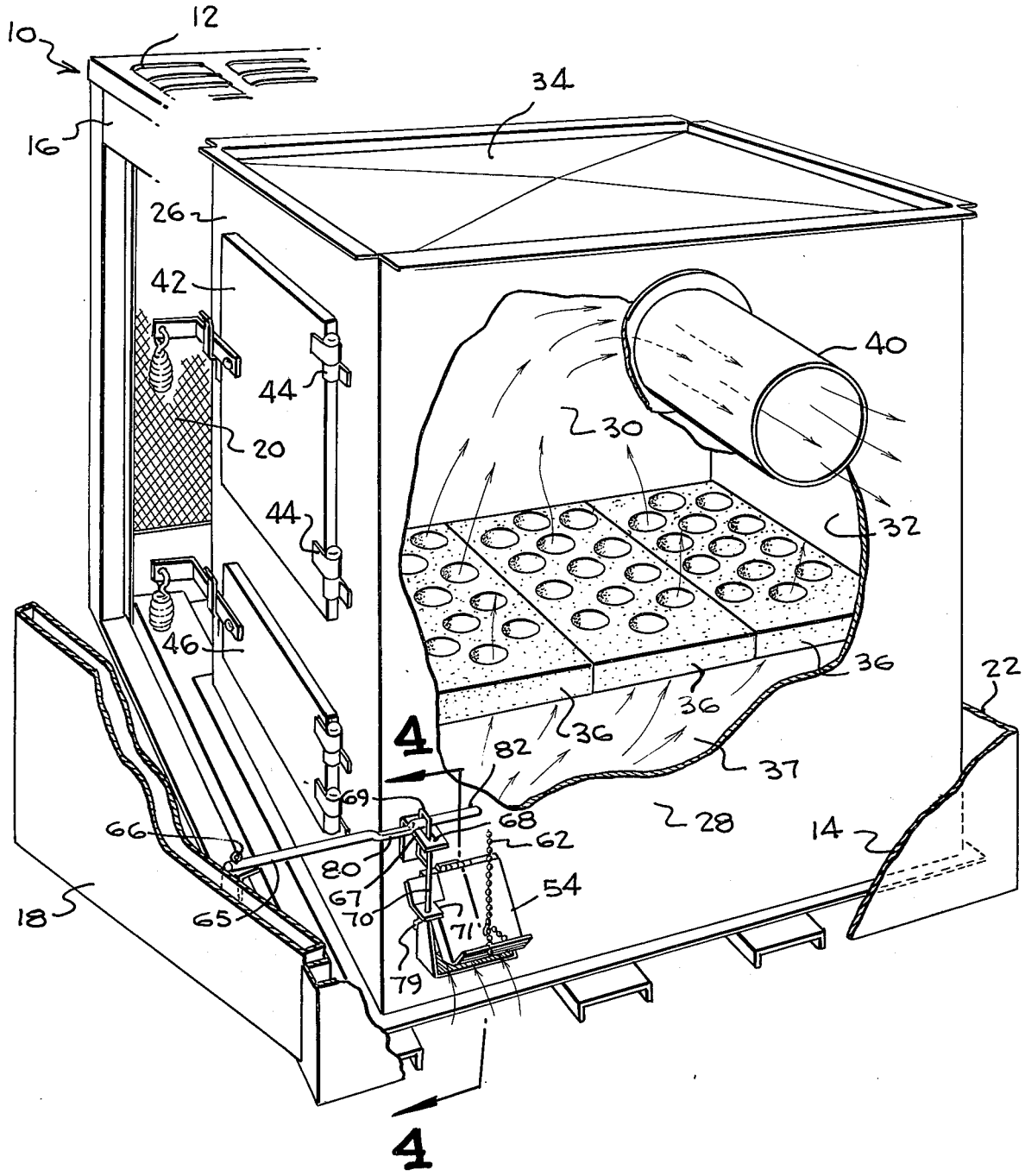
FIG. 1 is a perpective view of the preferred embodiment of the invention illustrating the outer housing door in an open condition with portions removed for purposes of clarity of illustration.

The preferred embodiment of the invention, generally designated 10, comprises a solid fuel type combustion heater consisting of an outer housing including a louvered top wall 12, a rear wall 14 and a side wall 16 in which an outer housing door 18 is provided for hinged movement about its right edge portion in a manner that will be apparent from comparison of FIG. 1 and FIG. 2. The outer housing also includes a front grilled wall 20 opposite rear wall 14 and a side wall 22 opposite the side wall 16 and door 18 as shown in FIG. 1.

A closed combustion chamber housing is mounted internally of but spaced from the walls of the outer housing and includes a side wall 26, rear wall 28 and front wall 30, a side wall 32 and a wall 34. Grates 36 are provided on the interior of the combustion chamber with an ash pit 37 being provided beneath the grates in a well-known manner. A flue pipe 40 extends outwardly from the upper portion of the combustion chamber through an opening in the rear wall 14 of the outer housing. A fuel feed door 42 is hingedly supported by hinge means 44 on the upper portion of the side wall 26 of the combustion chamber and an ash pit door 46 is provided in the lower portion of the side wall 26 to permit the removal of ashes from the ash pit area 37 beneath the grates 36.

A combustion air inflow opening 50 extends through the rear wall 28 of the combustion chamber housing into communication with the ash pit for permitting combustion air to flow inwardly into the combustion chamber to support the combustion of the solid fuel such as wood, coal or the like maintained on the grates 36. A shroud 52 extends outwardly from the rear wall 28.

Combustion air inflow control means including a pivotable closure member 54 is provided on shroud 52 for varying the amount of combustion air flowing into the combustion chamber. Hinge means 56 supports the upper edge of the closure member 54 on the upper portion of shroud 52 with the pivotable closure member 54 being movable between a closed position and an open position as illustrated in FIG. 4. It will be appreciated that when the pivotable closure member 54 is in the position of FIG. 3, no combustion air can flow into the combustion chamber while positioning of the pivotable closure member in an open position as exemplified in FIG. 4 permits the inflow of combustion air in an amount in proportion to the opening of the pivotable closure member. Consequently, the pivotable closure member 52 serves as a valving member. Shroud 52 is shaped with inclined edges 53 on its side walls so that the action of gravity on the pivotable closure member 54 tends to move and hold the closure member in a closed condition illustrated in FIG. 3.

Automatic positioning of the pivotable closure member 54 during use of the heater is effected by a thermostat assembly 60 of conventional design which is positioned in the space between the combustion chamber housing and the outer housing above the pivotable closure member 54. A flexible chain 62 extends between the thermostat means 60 and the pivotable closure member to open the closure member when the temperature falls below a peredetermined level in accordance with the adjustment of the thermostatic control means 60. Chain adjustment means 64 permits adjustment of the chain connection to the pivotable closure member 54 in an obvious manner.

A dangerous blowback expelling of flame and smoke from the fuel feed door 42 can occur when that door is opened at a time when the pivotable closure member 54 is in a closed condition. The dangerous blowback is due to the rapid ignition of gases in the combustion chamber as a result of the entry of combustion supporting air into the combustion chamber upon the opening of door 42. This invention prevents such blowback by opening the pivotable closure member 54 in response to the opening of the outer housing door 18 before the user of the device can open the fuel feed door 42. Such opening of the pivotable closure member 52 serves to permit controlled ignition of the fuel and gas in the combustion chamber so that there is no blowback upon the opening of the fuel feed door 42.

Avoidance of blowback is achieved by provision of an elongated cam rod 65 having one end pivotally connected to the outer housing door 18 at 66 and having its opposite end riding on a fixed slide support bracket 67 mounted on the rear wall 28 of the combustion chamber. A slot 68 is provided in the slide support bracket 67. A wire loop 69 on the upper end of a wire bail member 70 extends about cam rod 65 from which it is supported. Bail member 70 has a lower end that loosely extends through an opening in a lift tab 71 fixed to the outer face of pivotable closure member 54. A bent lug portion 79 is positioned beneath the lift bracket 71 so that any upward vertical movement of the bail 70 will result in engagement of the bent lug member 79 with lift tab 71 to move the pivotable closure member 54 from its closed position to an open position.

Cam rod 65 has an upper surface which includes a relatively thin depressed surface portion 80 and an elevated surface portion 82 with depressed surface portion 80 being positioned on the slide support bracket 67 beneath loop 69 of the wire bail when the outer housing door 18 is in a closed position as illustrated in FIG. 2 and FIG. 3. Consequently, the pivotable closure member 54 can move to the closed position when the chain 62 permits such movement. However, operation of the thermostat control means 60 can position chain 62 so that the pivotable closure member 54 is in an open position as illustrated in FIG. 4 without the bail member 70 resisting opening of the closure member 54 in any manner.

The elevated surface portion 80 of the cam rod 65 is dimensioned so that opening of the door 18 results in the lifting of bail member 70 by an amount sufficient to open pivotable closure member 54 when the closure member is initially in or near its closed position. Consequently, combustion air can flow into the combustion chamber to ignite the gases and fuel therein and effect a draft through the combustion chamber upwardly and outwardly through the flue pipe 40 so that the subsequent opening of the fuel feed door 42 does not create a sudden ignition in the combustion chamber which can result in the blowback ejection of flame and smoke outwardly into the room in which the heater is located.

It should be understood that if the closure member 54 is already in an open condition when door 18 is opened, there will be no effect on the closure member since wire bail 70 will merely slide in the opening in lift tab 71 with bent lug 79 not being lifted high enough to engage the lower surface of lift tab 71.

It will be appreciated that the means for automatically opening the pivotable closure member 54 is simple in construction but will provide a totally reliabel and trouble-free operation without any maintenance or care being required. While numerous modifications of the subject invention will undoubtedly occur to those of skill in the art, it should be appreciated that the spirit and scope of the invention is to be limited solely by the appended claims.

I claim:

1. A solid fuel burning heating unit comprising a closed combustion chamber having a fuel feed door movable between an open position, combustion air inflow control means for varying the flow of combustion air into said closed combustion chamber and an outer housing enclosing said closed combustion chamber with the outer housing having an outer housing door permitting access to the fuel feed door and camming means connected to said combustion air inflow control means for insuring that said combustion air inflow control means is positioned to permit the inflow substantial quantities of air into said combustion chamber door when said outer housing door is opened.

2. The invention of claim 1 wherein said combustion air inflow control means includes an air inflow opening in said combustion chamber, a pivotable closure member mounted adjacent said air inflow opening and movable between a closed position substantially blocking said air inflow opening and an open position not blocking said air inflow opening permitting the flow of air into said closed combustion chamber.

3. The invention of claim 1 wherein said combustion air inflow control means includes an air inflow opening in said combustion chamber, a pivotable closure member mounted adjacent said air inflow opening and movable between a closed position substantially blocking said air inflow opening and an open position not blocking said air inflow opening permitting the flow of air into said closed combustion and hinge means supporting said pivotable closure member so that the force of gravity acting on said pivotable closure member tends to move said pivotable closure member to its closed position.

4. The invention of claim 1 wherein said combustion air inflow control means includes an air inflow opening in said combustion chamber, a pivotable closure member mounted adjacent said air inflow opening and movable between a closed position substantially blocking said air inflow opening permitting the flow of air into said closed combustion chamber, hinge means supporting said pivotable closure member so that the force of gravity acting on said pivotable closure member tends to move said pivotable closure member to its closed position, theremostat control means including a temperature sensitive element positioned between the closed combustion chamber housing and the outer housing above said pivotable closure member and flexible linkage means extending between said thermostat control means and said pivotable closure member for permitting said thermostat control means to effect the positioning of said pivotable closure member in accordance with the temperature of the air surrounding said thermostat control means.

5. The invention of claim 1 wherein said combustion air inflow control means includes an air inflow opening in said combustion chamber, a pivotable closure member mounted adjacent said air inflow opening and movable between a closed position sustantially blocking said air inflow opening and an open position not blocking said air inflow opening permitting the flow of air into said closed combustion chamber, hinge means supporting said pivotable closure member so that the force of gravity acting on said pivotable closure member tends to move said pivotable closure member to its closed position, thermostat control means including a temperature sensitive element positioned between the closed combustion chamber housing and the outer housing above said pivotable closure member, flexible linkage means extending between said theremostat control means and said pivotable closure member for permitting said thermostat control means to effect the positioning of said pivotable closure member in accordance with the temperature of the air surrounding said thermostat control means and wherein said camming means comprises an elongated rod member pivotally connected on one end to said outer housing door and having an upper surface including a depressed portion and a raised portion, a fixed slide support means positioned above said pivotable closure member and supporting said elongated rod member for sliding movement thereon in response to opening or closing movement of said outer housing door, cam follower means resting on the upper surface of said elongated cam rod member and connected to said pivotable closure member, said depressed portion of said elongated cam rod member being positioned beneath said cam follower means when said outer housing door is closed, said raised portion of said elongated cam rod member being moved beneath said cam follower means in response to the opening of said outer housing door so as to effect opening movement of said pivotable closure member by the opening of said outer housing door.

6. The invention of claim 5 wherein said cam follower means comprises a wire-like bail member having a loop portion at its upper end encirculing said elongated cam rod member and extending downwardly through a slot in said slide support means and having a lower end engaged with said pivotable closure member.

7. A solid fuel burning heat unit comprising a closed combustion chamber housing having a fuel feed door movable between an open position and a closed position, combustion air inflow valving means for varying the flow of combustion air into said closed combustion chamber housing and an outer housing enclosing said closed combustion chamber housing to define a space between the outer housing and the combustion chamber housing with the outer housing having an outer housing door permitting access to the fuel feed door, thermostat means connected to said combustion air inflow valving means for actuating said combustion air inflow valving means to vary the inflow of air into said combustion chamber in accordance with the temperature of the space between the combustion chamber and the outer housing and camming means operable in response to the opening of said outer housing door for moving said valving means to an open position if said valving means is near a closed condition when said outer housing door is opened.

8. The invention of claim 7 wherein said combustion air inflow valving means includes an air inflow opening in said combustion chamber housing, a pivotable plate mounted adjacent said air inflow opening and movable between a closed position substantially blocking said air inflow opening and an open position permitting the flow of air through said inflow opening into said closed combustion chamber housing.

9. The invention of claim 7 wherein said combustion air inflow valving means includes an air inflow opening in a wall of said combustion chamber housing, a pivotable closure member comprising a metal plate mounted adjacent said air inflow opening and movable between a closed position substantially blocking said air inflow opening and an open position permitting the flow of air into said closed combustion chamber housing and hinge means supporting said metal plate so that the force of gravity acting on said metal plate tends to move said metal plate to its closed position.

10. The invention of claim 9 additionally including thermostat control means including a temperature sensitive element positioned between the closed combustion chamber housing and the outer housing above said metal plate and flexible linkage means extending between said thermostat control means and said metal plate for permitting said thermostat control means to effect the positioning of said metal plate in accordance with the temperature of the air surrounding said thermostat control means.

11. The invention of claim 7 wherein said combustion air inflow valving means includes an air inflow opening in said combustion chamber housing, a pivotable closure member mounted adjacent said air inflow opening and movable between a closed position substantially blocking said air inflow opening and an open position permitting the flow of air into said closed combustion chamber, hinge means supporting said pivotable closure member so that the force of gravity acting on said pivotable closure member tends to move said pivotable closure member to its closed position, thermostat control means including a temperature sensitive element positioned between the closed combustion chamber housing and the outer housing above said pivotable closure member, flexible linkage means extending between said thermostat control means and said pivotable closure member for permitting said thermostat control means to effect the positioning of said pivotable closure member in accordance with the temperature of the air surrounding said thermostat control means and wherein said camming means comprises an elongated rod member pivotally connected on one end to said outer housing door and having an upper surface including a depressed portion and a raised portion, a fixed slide support means positioned above said pivotable closure member and supporting said elongated rod member for sliding movement thereon in response to opening or closing movement of said outer housing door, cam follower means resting on the upper surface of said elongated cam rod member and connected to said pivotable closure member, said depressed portion of said elongated cam rod member being positioned beneath said cam follower means when said outer housing door is closed, said raised portion of said elongated cam rod member being moved beneath said cam follower means in response to the opening of said outer housing door so as to effect opening movement of said pivotable closure member by the opening of said outer housing door.

12. The invention of claim 11 wherein said cam follower means comprises a wire-like bail member having a loop portion at its upper end encircling said elongated cam rod member and extending downwardly through a slot in said slide support means and having a lower end engaged with said pivotable closure member.

* * * * *